US008826501B2

(12) United States Patent
Khoury et al.

(10) Patent No.: US 8,826,501 B2
(45) Date of Patent: Sep. 9, 2014

(54) GARMENT CLIP

(76) Inventors: Edward Joseph Khoury, Batemen (AU); Wendy Kathleen Flack, Currumbine (AU)

( * ) Notice: Subject to any disclaimer, the term of this patent is extended or adjusted under 35 U.S.C. 154(b) by 282 days.

(21) Appl. No.: 13/514,432

(22) PCT Filed: Dec. 1, 2010

(86) PCT No.: PCT/AU2010/001618

§ 371 (c)(1),
(2), (4) Date: Jun. 7, 2012

(87) PCT Pub. No.: WO2011/069185

PCT Pub. Date: Jun. 16, 2011

(65) Prior Publication Data

US 2012/0255148 A1 Oct. 11, 2012

(30) Foreign Application Priority Data

Dec. 8, 2009 (AU) ..... 2009905970

(51) Int. Cl.
*A41F 1/00* (2006.01)
*A44B 11/00* (2006.01)

(52) U.S. Cl.
CPC ..... *A44B 11/006* (2013.01); *A41F 1/00* (2013.01)
USPC ..... 24/485; 24/329

(58) Field of Classification Search
CPC ..... A41F 1/08; A41F 1/008; A41F 1/00; A41F 1/006; A41D 2400/44; A41D 2400/70; A44C 5/185; A44C 5/2057; A44C 5/2066; A44C 5/2071; A44C 5/2085
USPC ..... 24/485, 490, 491, 492, 515, 517, 327, 24/329, 336, 338, 340, 341, 343, 346
See application file for complete search history.

(56) References Cited

U.S. PATENT DOCUMENTS

| | | | | | |
|---|---|---|---|---|---|
| 730,490 | A | * | 6/1903 | Till | 24/331 |
| 1,030,386 | A | * | 6/1912 | Comeau | 24/515 |
| 1,784,717 | A | * | 12/1930 | Barnes | 24/485 |
| 2,397,284 | A | * | 3/1946 | Miller | 24/601.5 |
| 3,049,782 | A | * | 8/1962 | Hawie | 24/532 |
| 4,158,906 | A | * | 6/1979 | Watson | 24/306 |

FOREIGN PATENT DOCUMENTS

| | | | |
|---|---|---|---|
| DE | 3829211 | C1 | 5/1989 |
| GB | 635634 | A | 4/1950 |

* cited by examiner

*Primary Examiner* — Jack W Lavinder
(74) *Attorney, Agent, or Firm* — John Alumit

(57) ABSTRACT

A garment clip comprising a body having an opening on a first side thereof and a clamp member having teeth thereon adjacent a first side thereof. The clamp member is receivable in the opening and slidable relative to the body from a first position in which a second opposite side of the clamp member is contained within the body and the first side thereof extends from the opening to a second position in which the clamp member is contained within the body. A connecting member is provided secured relative to the body when the clamp member is in the second position thereof. A portion of material received between the teeth of the clamp member when the clamp member is in the first position is engaged by the teeth when the clamp member slides to the second position and the connecting member is engageable with a further garment clip.

18 Claims, 15 Drawing Sheets

GARMENT CLIP

CROSS-REFERENCE TO RELATED APPLICATION

This application claims the benefit of the priority filing date in PCT/AU2010/001618 referenced in WIPO Publication WO/2011/069185. The earliest priority date claimed is Dec. 8, 2009.

FEDERALLY SPONSORED RESEARCH

None

SEQUENCE LISTING OR PROGRAM

None

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention relates to a clip for use in securing garments such as underwear.

Standard underwear garments that are worn by sliding over the feet and legs can present difficulties in certain circumstances. People who have injuries to their legs or backs, for example, can find it difficult to bend sufficiently to put the underwear on in the normal manner. The use of plaster casts for broken bones in the leg is another situation that can also make the task difficult to accomplish.

While some medical undergarments exist that remove the need for the underwear to be slid over the feet, the use of such underwear may not be particularly desirable for use over extended periods. The present invention relates to a device provided for use with regular underwear in order to make the task of putting the underwear on and taking it off easier.

SUMMARY OF THE INVENTION

According to one aspect of the present invention there is provided a garment clip comprising: a body having an opening on a first side thereof; a clamp member having teeth thereon adjacent a first side thereof, the clamp member being receivable in the opening and slidable relative to the body from a first position in which a second opposite side of the clamp member is contained within the body and the first side thereof extends from the opening to a second position in which the clamp member is contained within the body; and a connecting member secured relative to the body when the clamp member is in the second position thereof; wherein a portion of material received between the teeth of the clamp member when the clamp member is in the first position is engaged by the teeth when the clamp member slides to the second position and the connecting member is engageable with a further garment clip.

Preferably, the connecting member of the garment clip engages with the further garment clip such that the connected garment clips are pivotally connected.

Preferably, when the connecting member is engaged with the further garment clip, said engagement prevents the clamp member of the further garment clip from moving from the second position to the first position thereof.

In a preferred embodiment, the body comprises first and second parallel side walls joined along the second side thereof by an interconnecting portion and the clamp member is formed from first and second side walls joined along the second side thereof by an interconnecting portion.

Preferably, the clamp member is received within the body such that the first side wall of the clamp member is adjacent the first side wall of the body and the second side wall of the clamp member is adjacent the second side wall of the body. Preferably, in the second position, the interconnecting portion of the clamp member is located adjacent the interconnecting portion of the body.

In one embodiment, the first and second side walls of the clamp member are angled such that first sides thereof are further apart than the second sides adjacent the interconnecting portion so that when the clamp member moves to the second position thereof, the first sides of the first and second side walls move closer together.

In one embodiment, the teeth are provided on inner surfaces of each of the side walls of the clamp member adjacent the first sides thereof.

Preferably the teeth on the first side wall are offset from the teeth on the second side wall such that, in the second position, the teeth on the first side wall intermesh with the teeth on the second side wall.

In a preferred embodiment, the connecting member comprises a hook connected to the clamp member, the hook comprising: a first elongate portion located between the first and second side walls adjacent the interconnecting portion; an arcuate portion extending around a first end of the clamp member; and a second elongate portion extending parallel to the first elongate portion on an opposite side of the interconnecting portion; wherein the second elongate portion is received between the side walls of the clamping member of the further garment clip.

Preferably, the second elongate portion of the hook is provided with a recess on a side adjacent the clamp member and the interconnecting portion of the body is provided with a protrusion on an inner surface adjacent a second end thereof such that the protrusion of each garment clip is received within the recess of the further garment clip.

In one embodiment, the interconnecting portion of the body is provided with a cut away section adjacent the first end thereof such that the second elongate portion of the hook passes through the cut away portion when the clamp member and the hook slide from the first position to the second position.

A first tab preferably extends from the first side wall of the clamp member creating an opening between the first tab and the interconnecting portion for receiving the first elongate portion of the hook.

A second flexible tab is preferably provided adjacent the first tab extending inwardly from the interconnecting portion to engage with a corresponding notch in the first elongate portion of the hook to retain the hook.

Preferably, the second elongate portion of the hook is circular in transverse cross section.

In a preferred embodiment, the second elongate portions of a pair of connected garment clips are coaxial when the first and second garment clips are connected such that the connected garment clips can pivot relative to each other about the common longitudinal axis of the second elongate portions of the hooks.

In one embodiment, the first and second side walls of the clamp member are provided with slots extending parallel to the direction of movement between the first and second positions thereof and the side walls of the body are provided with lugs extending from inner surfaces thereof such that the lugs are received in the slots to guide movement of the clamp member between the first and second positions thereof. Preferably, the lugs engage with inner ends of the slots to prevent the clamp member completely detaching from the body.

In one embodiment, a padding member is provided to be secured adjacent the first side walls of the connected garment clips such that the padding member rests between the garment clips and the skin.

Preferably, the padding member comprises a padded portion of material and a strip of material extending from a side thereof such that the strip of material is engaged with by the clamp and then folded to a position in which the padded portion of material is adjacent the first side walls of the connected garment clips located between the garment clips and the skin of the wearer.

BRIEF DESCRIPTION OF THE DRAWINGS

The invention will now be described, by way of example, with reference to the following drawings in which.

DETAILED DESCRIPTION OF PREFERRED EMBODIMENTS

Figure 1:
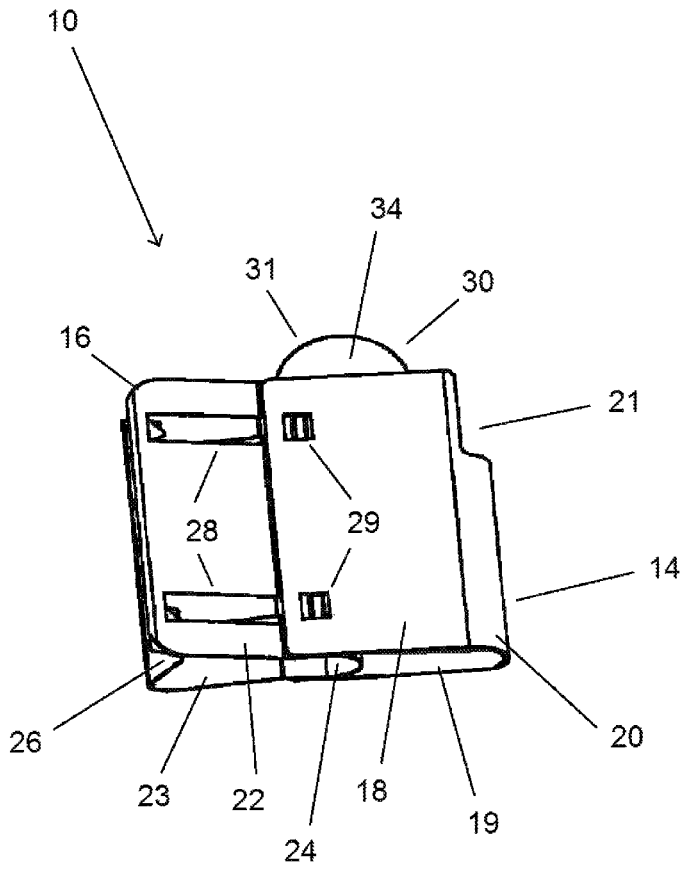
FIG. 1 is a perspective view of a garment clip in accordance with the present invention.
Figure 2:
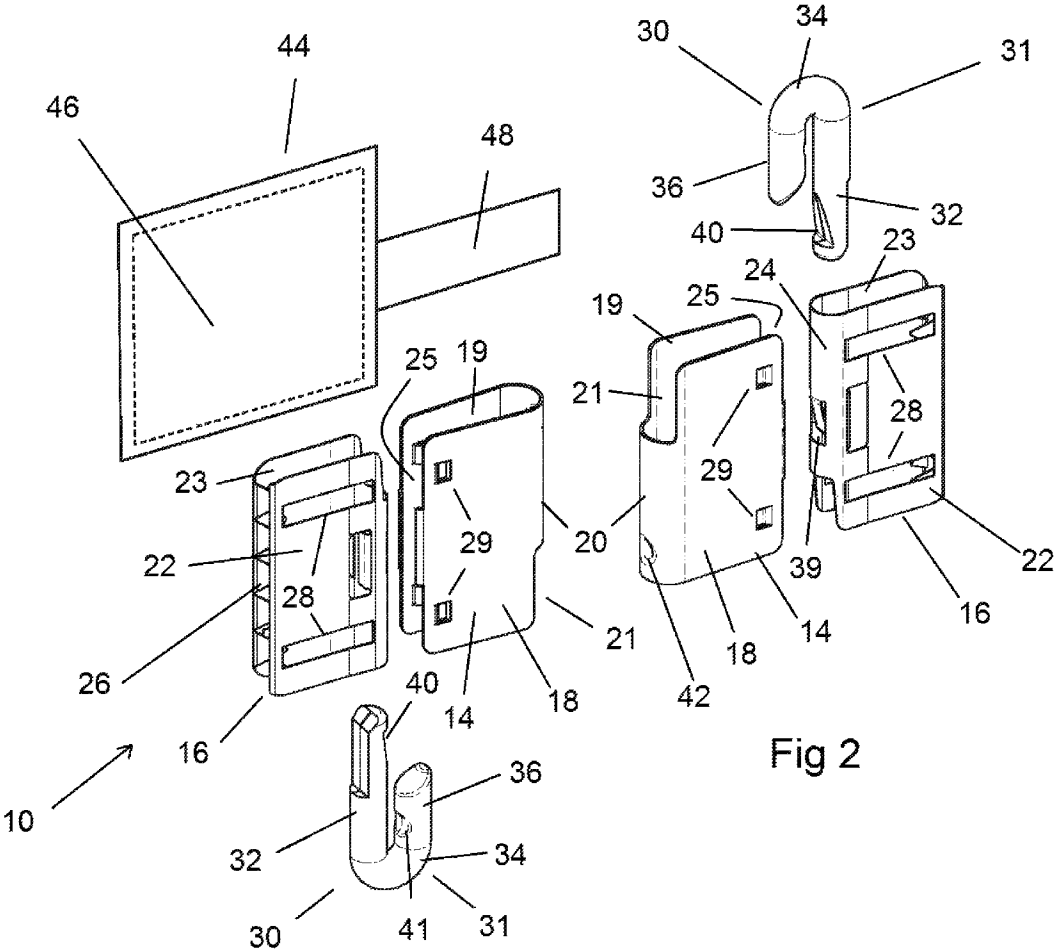
FIG. 2 is an exploded view of a pair of garment clips.

Referring to the Figures, there is shown a garment clip 10 for use on a garment such as a standard pair of underwear. The garment clips 10 of the present invention are to be used in pairs in order to secure a first portion 12*a* of material to a second portion 12*b* of material. In particular, a side of the pair of underwear is to be cut adjacent the hip of the wearer such that the cut ends comprise the first and second portions 12*a* and 12*b* of material. A first garment clip 10*a* is securable to the first portion 12*a* of material and a second garment clip 10*b* is securable to the second portion 12*b* of the material.

Each of the garment clips 10 comprises a body 14 and a clamp member 16. An opening 25 is provided in the body 14 on a first side thereof. The clamp member 16 is slidable from a first position in which a portion of the clamp member 16 extends from the opening 25 in the body 14 to a second position in which the clamp member 16 is fully contained within the body 14.

The body 14 comprises a sleeve having first and second parallel side walls 18 and 19. The first and second side walls 18 and 19 are generally rectangular in shape and are joined along a second side thereof by an interconnecting portion 20. The opening 25 is defined between the first and second side walls 18 and 19 on a side of the body 14 opposite the interconnecting portion 20.

The clamp member 16 is also formed from first and second side walls 22 and 23. The clamp member 16 is provided with a plurality of teeth 26 thereon adjacent a first side thereof. The first and second side walls 22 and 23 are joined along a second side thereof by an interconnecting portion 24. The teeth 26 are provided on inner surfaces of each of the side walls 22 and 23 of the clamp member 16 such that movement of the first side wall 22 towards the second side wall 23 causes the teeth 26 to move towards each other.

The teeth 26 on the first side wall 22 are preferably offset from the teeth 26 on the second side wall 23 such that in the second position of the clamp member 16, the teeth 26 on the first side wall 22 intermesh with the teeth 26 on the second side wall 23.

The clamp member 16 is received in the opening 25 such that the first side wall 22 of the clamp member 16 is adjacent the first side wall 18 of the body 14 and the second side wall 23 of the clamp member 16 is adjacent the second side wall 19 of the body 14. In the first position, the second side of the clamp member 16 is received in the opening 25 and the first side thereof extends beyond the opening 25. The clamp member 16 slides to the second position thereof towards the second side of the body 14 such that the clamp member 16 is fully contained within the body 14. In the second position, the first side of the clamp member 16 is adjacent the first side of the body 14.

The first and second side walls 22 and 23 of the clamp member 16 are angled such that first sides thereof are further apart than the second sides adjacent the interconnecting portion 24. The first and second side walls 22 and 23 of the clamp member 16 can flex about the interconnecting portion 24 such that when the clamp member 16 moves to the second position thereof, the first sides of the first and second side walls 22 and 23 move closer together.

The first and second side walls 22 and 23 of the clamp member 16 are provided with slots 28 extending parallel to the direction of movement between the first and second positions thereof. The side walls 18 and 19 of the body 14 are provided with lugs 29 extending from inner surfaces thereof. The lugs 29 are received in the slots 28 to guide movement of the clamp member 16 between the first and second positions thereof. The lugs 29 also engage with inner ends of the slots 28 to prevent the clamp member 16 completely detaching from the body 14.

Figure 3:
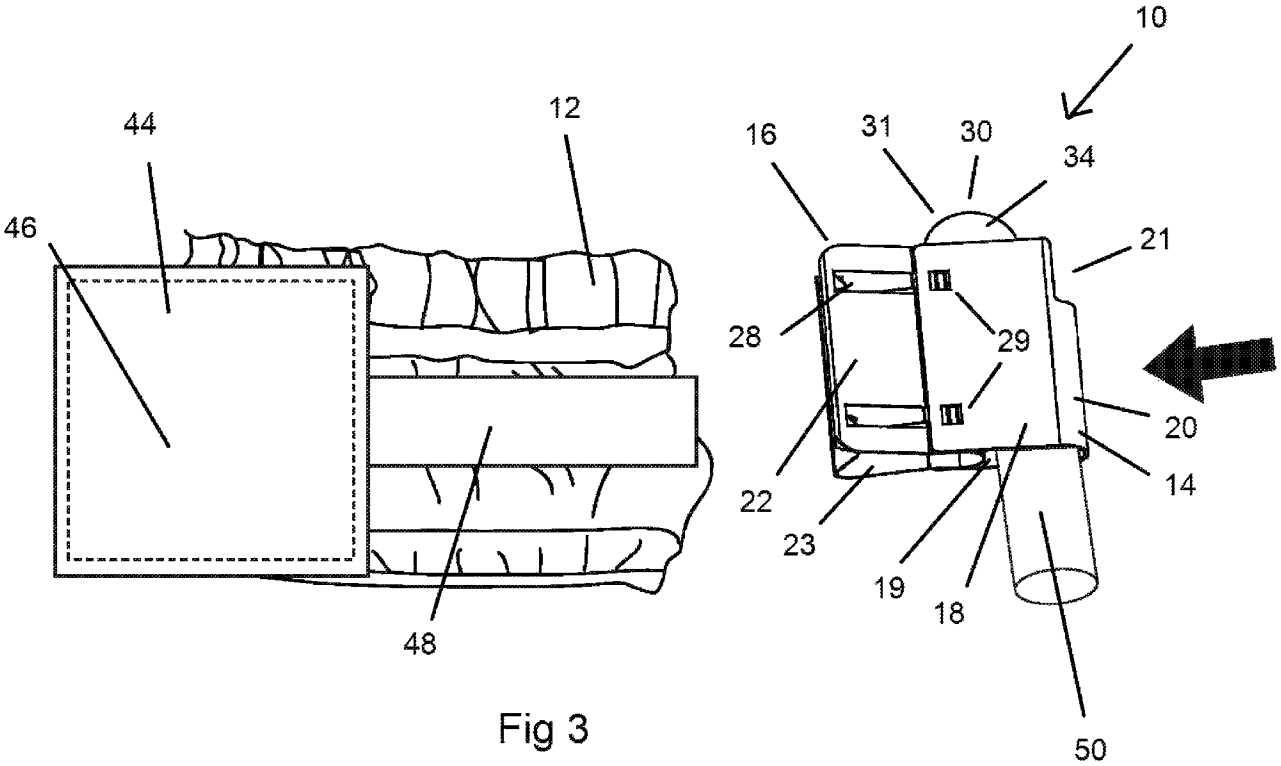
FIG. 3 is a front view of the garment clip of FIG. 1 prior to connection to a first portion of material, being a side of a pair of underwear.
Figure 4:
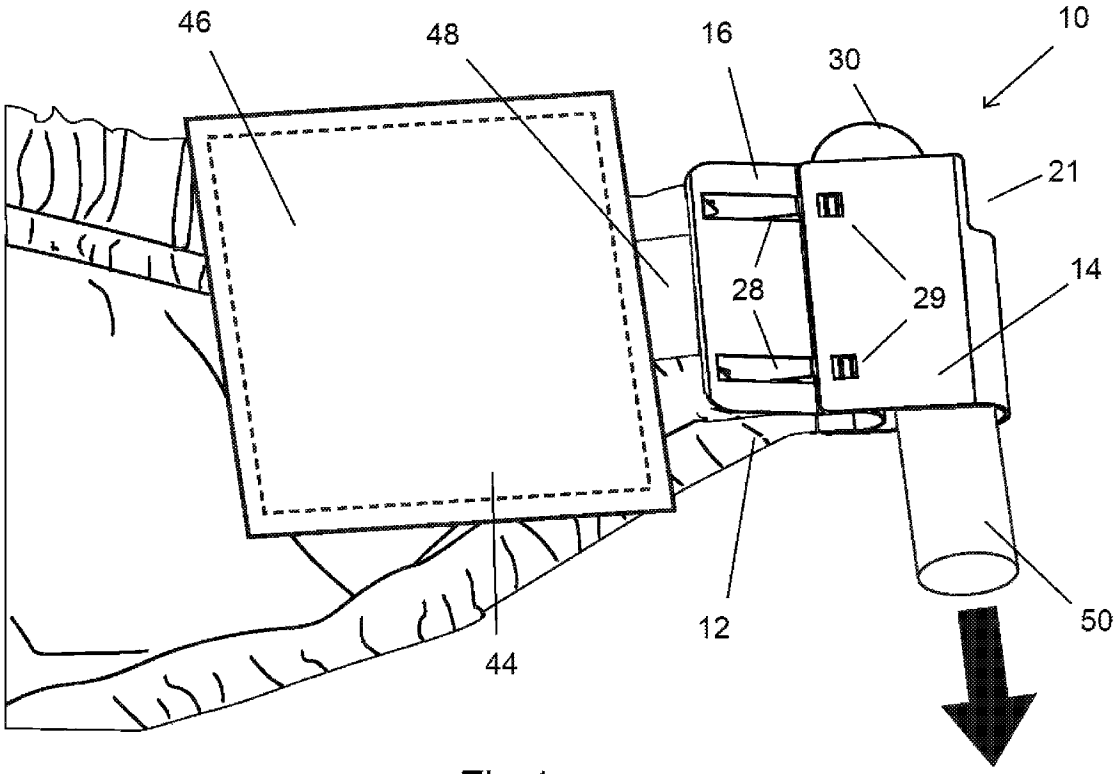
FIG. 4 is a front view of the garment clip of FIG. 1 partially connected to the first portion of material.
Figure 5:
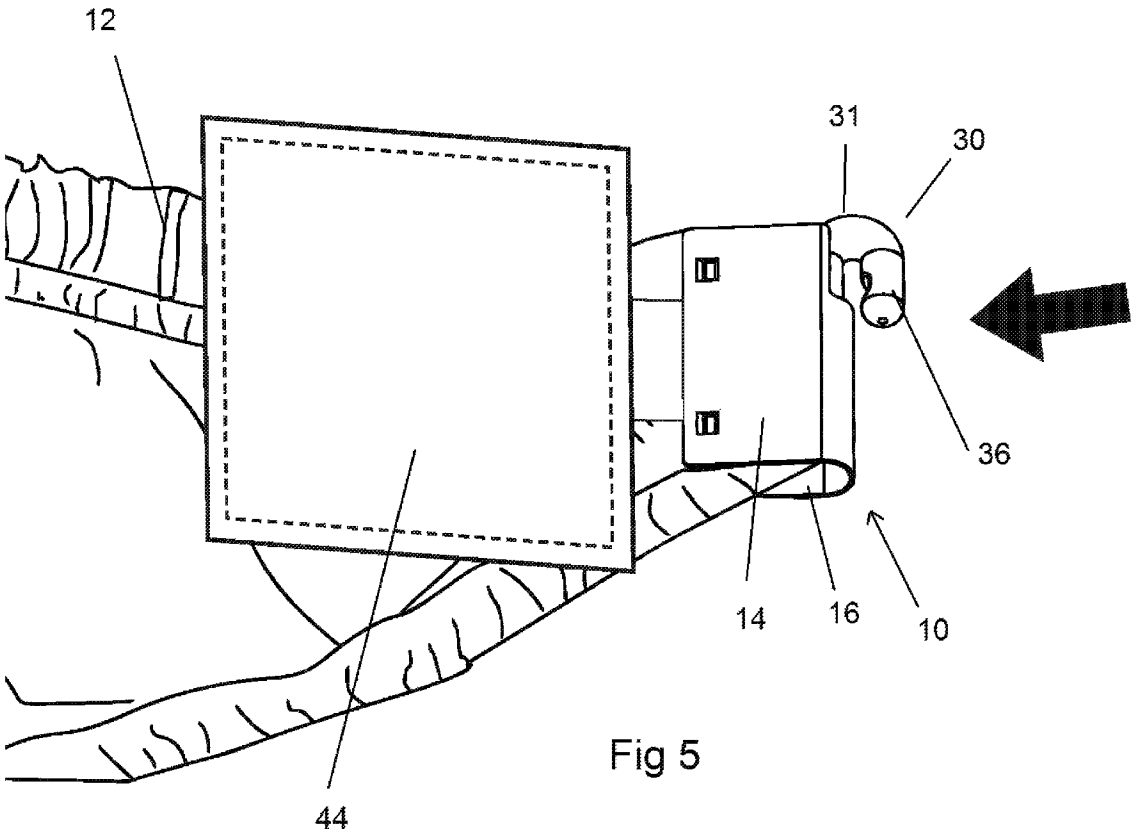
FIG. 5 is a front view of the garment clip of FIG. 1 connected to the first portion of material.
Figure 6:
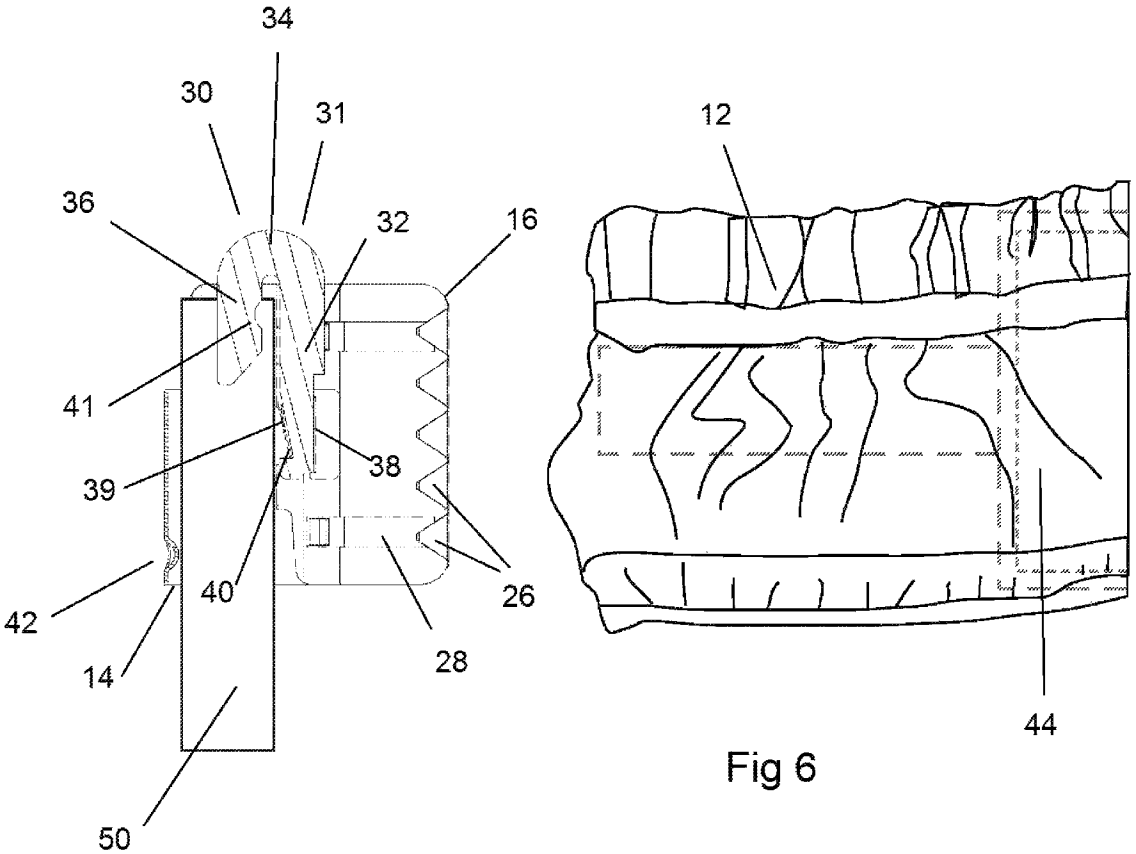
FIG. 6 is a rear cross sectional view of the garment clip of FIG. 1 prior to connection to the first portion of material.
Figure 7:
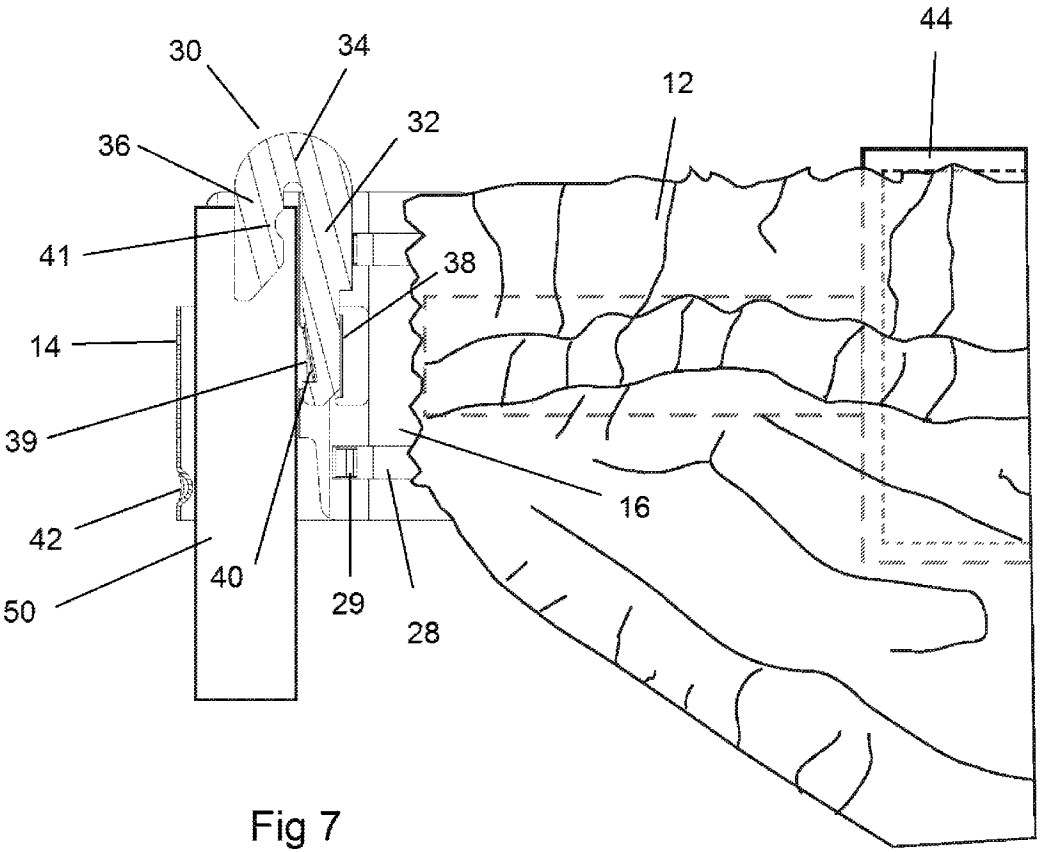
FIG. 7 is a rear cross sectional view of the garment clip of FIG. 1 with the first portion of material received in the clamp member.
Figure 8:
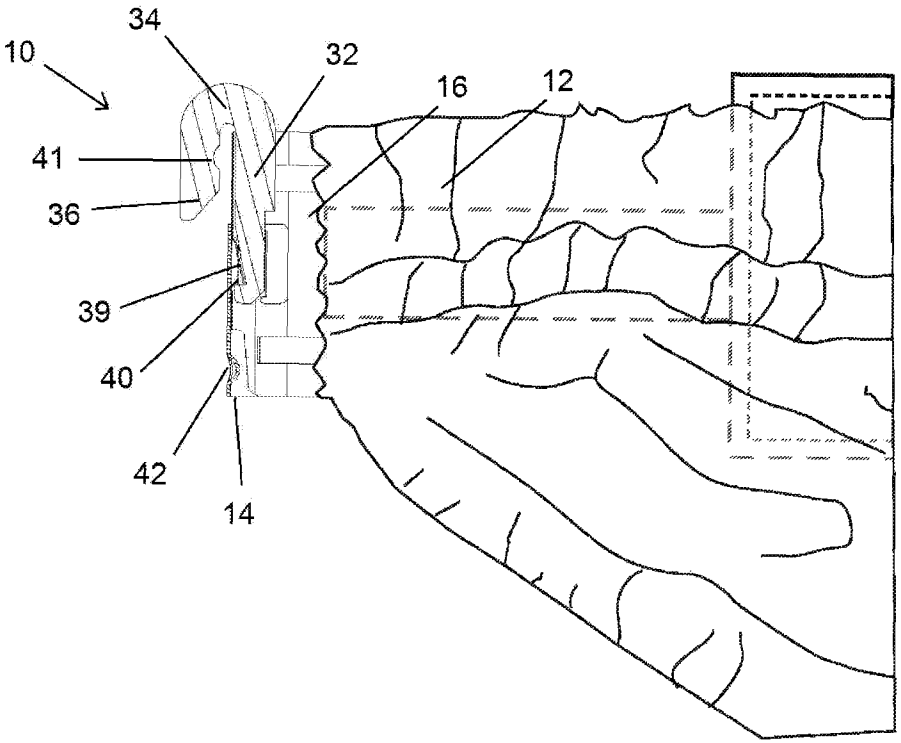
FIG. 8 is a rear cross sectional view of the garment clip of FIG. 1 connected to the first portion of material.

As can be seen on FIGS. 3 and 4, the portion of material 12 is received between the side walls 22 and 23 of the clamp member 16 when the clamp member 16 is in the first position thereof. The body portion 14 is then slid towards the clamp member 16 such that the clamp member 16 moves to the second position thereof. In the second position, the teeth 26 on the inner surfaces of the side walls 22 and 23 of the clamp member 16 engage into the portion of material 12, thereby clamping the portion of material 12 within the garment clip 10.

The garment clips 10 are also provided with a connecting member 30 to connect to a further garment clip 10. The connecting member 30 comprises a hook 31 connected to the clamp member 16. The hook 31 comprises a first elongate portion 32 located between the first and second side walls 22 and 23 of the clamp member 16 adjacent the interconnecting portion 24. A first tab 38 extends from the first side wall 22 of the clamp member 16 creating an opening between the first tab 38 and the interconnecting portion 24 for receiving the first elongate portion 32 of the hook 31. A second flexible tab 39 is provided adjacent the first tab 38 extending inwardly from the interconnecting portion 24. The second flexible tab 39 is received in a corresponding notch 40 in the first elongate portion 32 of the hook 31 to retain the first elongate portion 32.

The hook 31 includes an arcuate portion 34 that extends from the first elongate portion 32 around a first end of the interconnecting portion 24 to a second elongate portion 36. The second elongate portion 36 is oriented parallel to the first elongate portion 32 on the opposite side of the interconnection portion 24 of the clamp member 16. The interconnecting portion 20 of the body 14 is provided with a cut away section 21 adjacent a first end thereof such that the second elongate portion 36 of the hook 31 passes through the cut away portion 21 when the clamp member 16 and the hook 31 slide from the first position to the second position. The first and second elongate portions 32 and 34 of the hook 31 are circular in transverse cross section.

The second elongate portion 36 of the hook 31 is provided with a recess 41 on a side adjacent the clamp member 16. The interconnecting portion 20 of the body 14 is provided also with a protrusion 42 on an inner surface adjacent a second end thereof.

Figure 9:
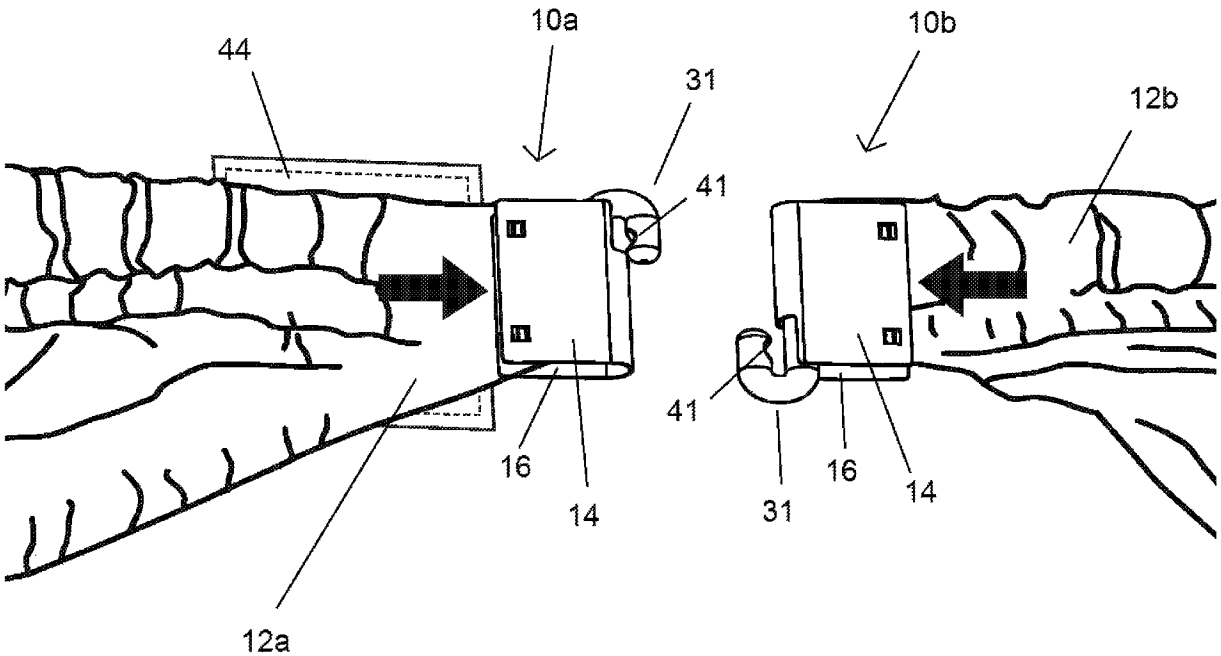
FIG. 9 is a front view of a first garment clip secured to a first portion of material and a second garment clip secured to a second portion of material, the first and second portions of material being portions of the side of a pair of underwear.

As can be seen in FIGS. 8 to 11, the first garment clip 10*a* is engaged with the second garment clip 10*b* by means of the hooks 31. The first and second garment clips 10*a* and 10*b* are held such that the interconnecting portions 20 thereof are adjacent and the garment clips 10 are offset (as shown in FIG. 9). The garment clips 10*a* and 10*b* are arranged such that the hooks 31 are pointing in opposite directions. By sliding the garment clips 10*a* and 10*b* towards each other in the direction of the second elongate portions 36, the second elongate portion 36 of the hook 31 of the first garment clip 10*a* is received between the first and second side walls 22 and 23 of the clamp member 16 of the second garment clip 10*b*. At the same time, the second elongate portion 36 of the hook 31 of the second garment clip 10*b* is received between the first and second side walls 22 and 23 of the clamp member 16 of the first garment clip 10*a*. The protrusions 42 in the bodies 14 engage with the recesses 41 in the hooks 31 to hold the first and second garment clips 10*a* and 10*b* together.

The second elongate portions 36 of each of the garment clips 10*a* and 10*b* are coaxial when the first and second garment clips 10*a* and 10*b* are engaged. Therefore, when engaged the first and second garment clips 10*a* and 10*b* can pivot relative to each other about the common longitudinal axis of the second elongate portions 36 of the hooks 31.

When the first and second garment clips 10*a* and 10*b* are connected, the clamp members 16 are prevented from returning to the second positions thereof. As the second elongate portion 36 of the hook 31 of the first garment clip 10*a* is received between the first and second side walls 22 and 23 of the clamp member 16 of the second garment clip 10*b*, the hook 31 engages with the clamp member 16 and prevents it returning to the second position. The receiving of the hook 31 of the second garment clip 10*b* within the clamp member 16 of the first garment clip 10*a* also prevents this clamp member 16 from returning to the first position. That is, when the first and second garment clips 10*a* and 10*b* are engaged, the clamp members 16 are locked in the second positions thereof such that the clamp members 16 will not release the portions of material 12*a* and 12*b*.

Figure 10:
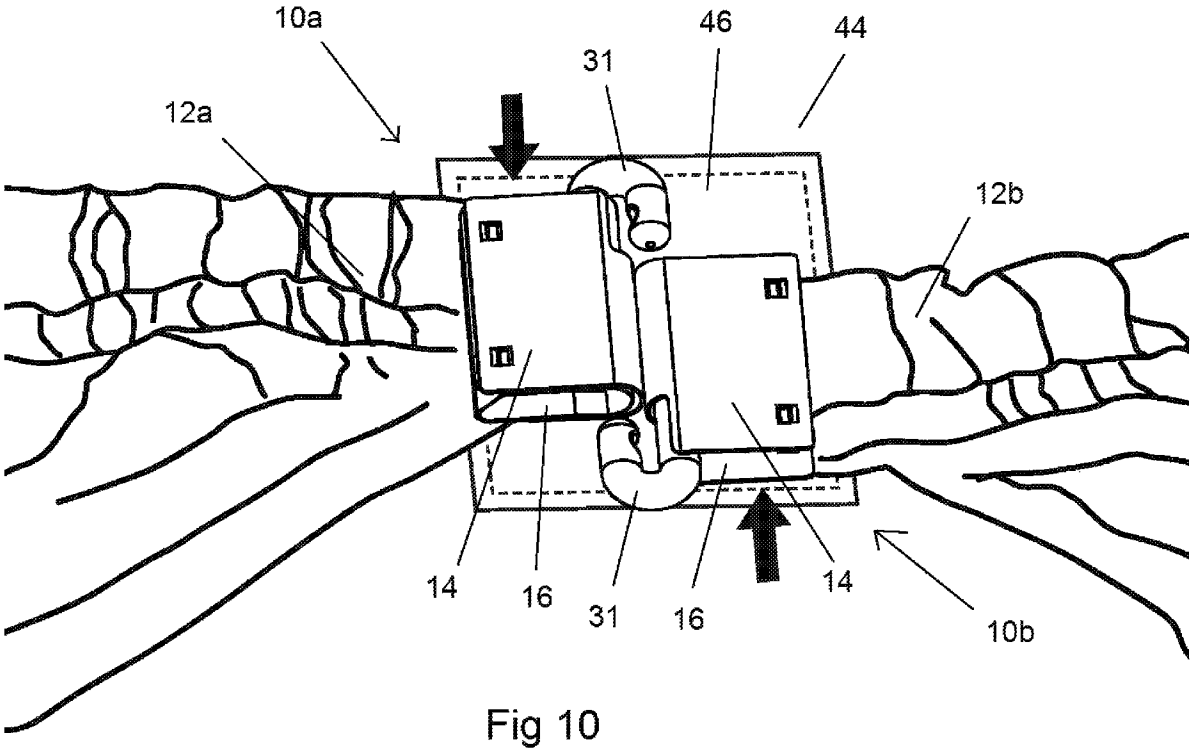
FIG. 10 is a view of the first and second garment clips prior to connection to each other.
Figure 11:
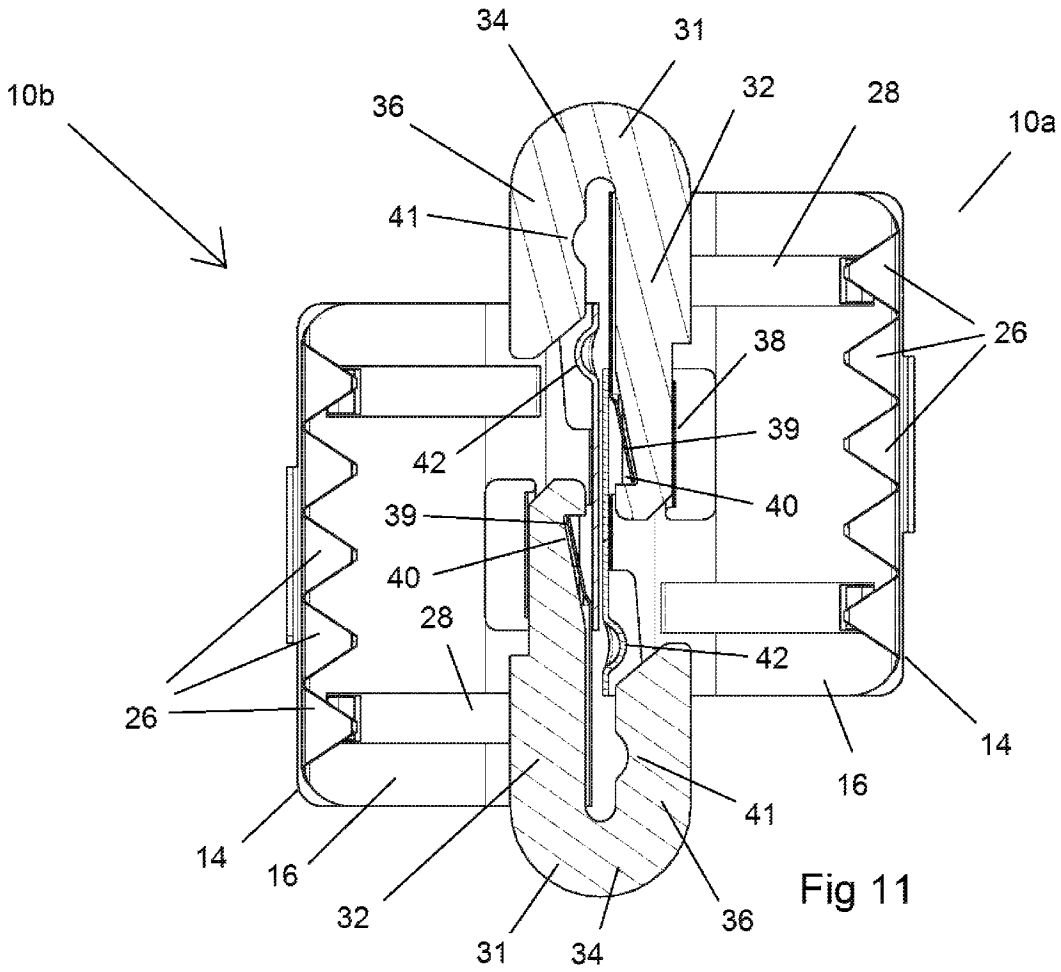
FIG. 11 is a cross sectional view of the first and second garment clips prior to connection to each other.
Figure 12:
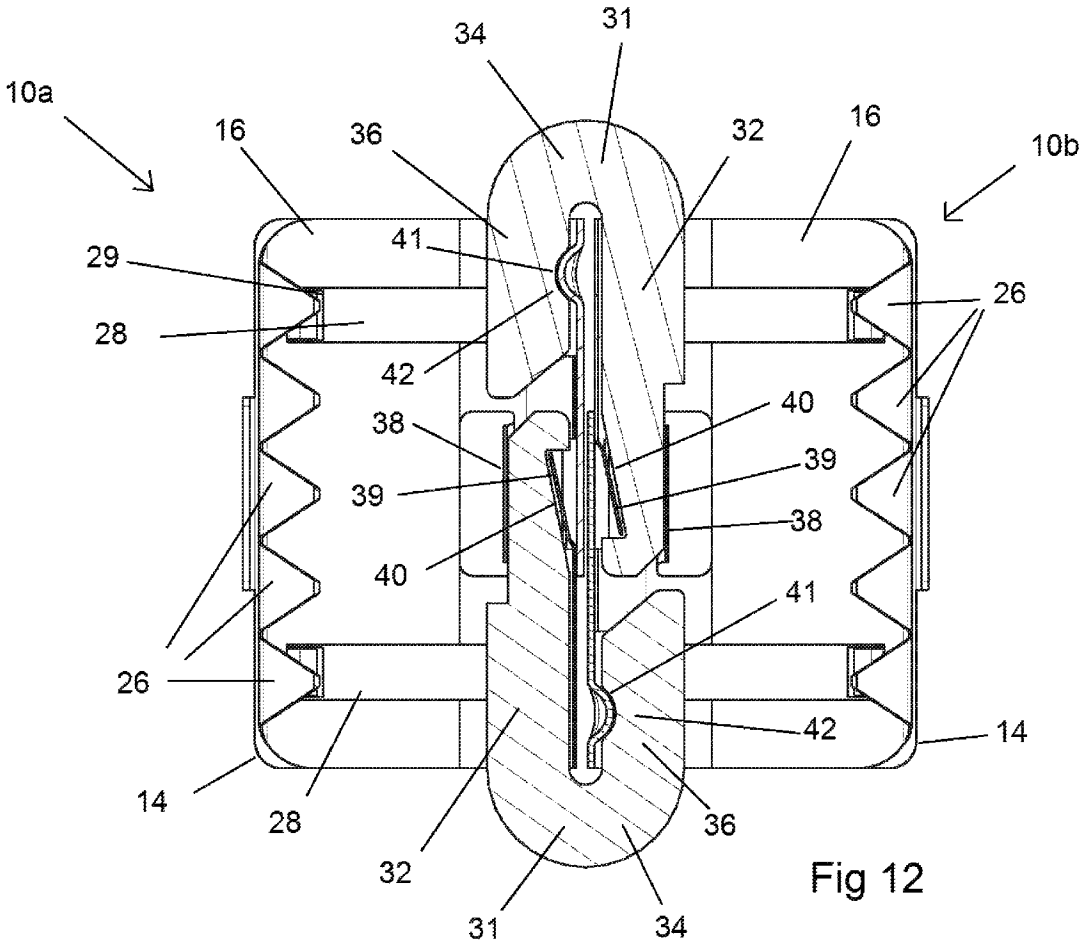
FIG. 12 is a cross sectional view of the first and second garment clips connected to each other.
Figure 13:
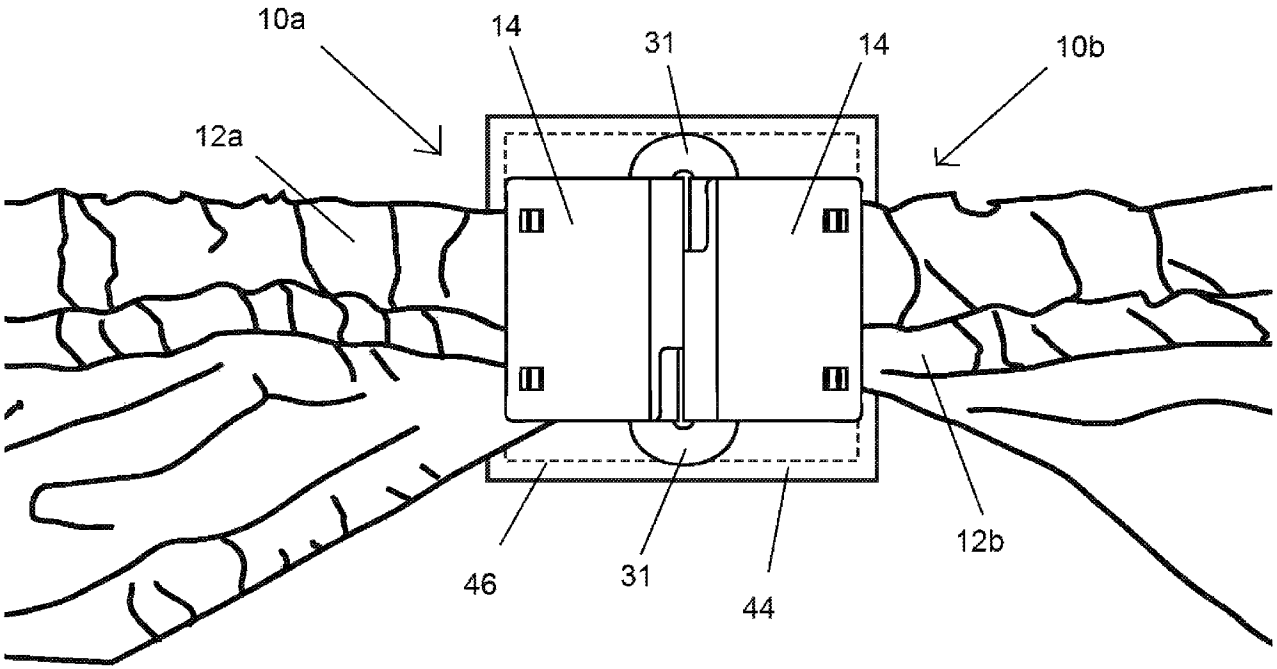
FIG. 13 is a front view of the connected first and second garment clips on the pair of underwear.
Figure 14C:
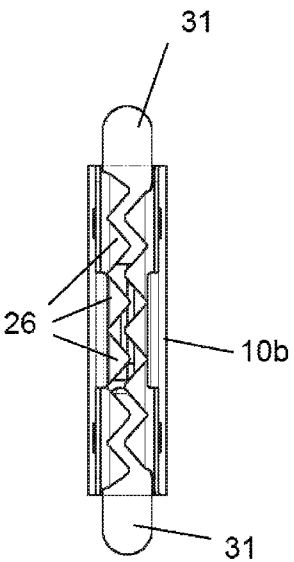
FIG. 14*c* is an end view of the connected first and second garment clips.
Figure 14B:
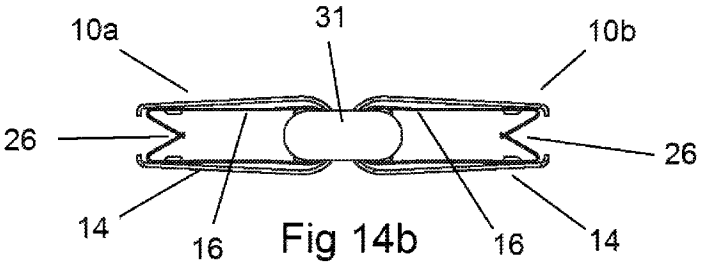
FIG. 14*b* is a top view of the connected first and second garment clips.
Figure 14A:
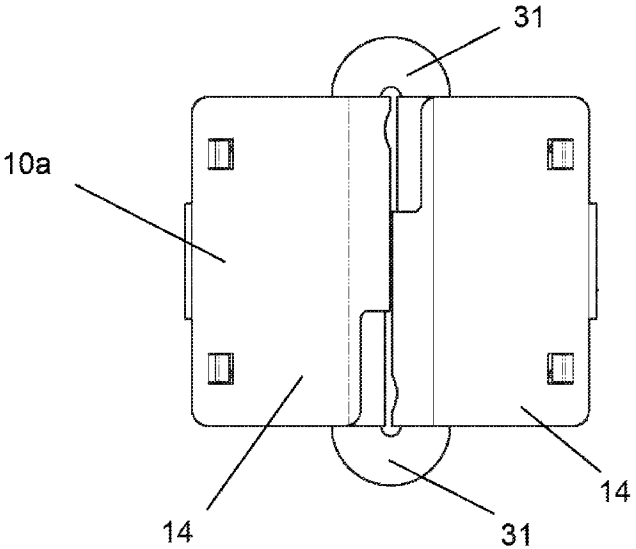
FIG. 14*a* is a front view of the connected first and second garment clips.
Figure 15:
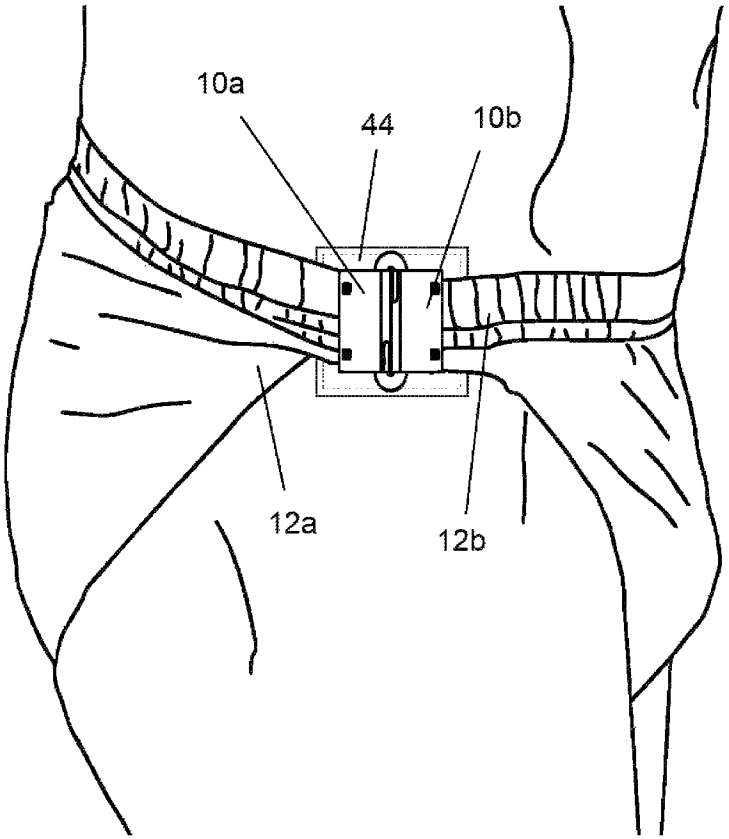
FIG. 15 is a side view of the first and second garment clips in use on the pair of underwear.

The garment clips 10*a* and 10*b* are also provided with a padding member 44. The padding member 44 is provided to be adjacent the first side walls 18 of the first and second garment clips 10*a* and 10*b* such that the padding member 44 rests between the garment clips 10*a* and 10*b* and the skin. The padding member 44 comprises a padded portion of material 46 and a strip of material 48 extending from a side thereof. As can be seen in FIGS. 3 and 4, the strip of material 48 is placed adjacent the portion of material 12 to which the garment clip 10 is to be connected. The strip of material 48 is engaged also by the clamp 16 and then folded to a position as shown in FIG. 10 in which the padded portion of material 46 is adjacent the first side walls 18 of the first and second garment clips 10*a* and 10*b* located between the garment clips 10*a* and 10*b* and the skin of the wearer.

A stopper member 50 may also be provided as shown in FIGS. 3 and 4. The stopper member 50 comprises a tubular member inserted between the interconnecting portion 24 of the clamp member 16 and the interconnecting portion 20 of the body 14 when the clamp member 16 is in the first position. The stopper member 50 prevents movement of the clamp member 16 towards the second position as the portion of material 12 is inserted into the clamp member 16. Once the portion of material 12 is in place, the stopper member 50 may be removed so that the clamp member 16 can be slid to the second position thereof.

In use, a standard pair of underwear can be cut on both sides such that the cut ends form the first and the second portions 12*a* and 12*b* of material. A pair of garment clips 10*a* and 10*b* can then be attached to the cut ends as shown in FIGS. 3 to 8 on each side of the pair of underwear. It is then possible to put on the underwear without the need to slide it over the feet and legs. The underwear can be placed in position and each side of the underwear and rejoined by connecting the adjacent garment clips 10*a* and 10*b* as shown in FIGS. 9 to 14.

The garment clips 10 allow the portions of material 12 to be detached by disengaging the hooks 31 by moving the garment clips 10*a* and 10*b* in the opposite directions and reattached as required.

The padding member 44 allows the garment clips 10 to be utilised without causing irritation to the wearer. Also, the ability of the connected garment clips 10*a* and 10*b* to pivot relative to each other also allows the garment clips 10*a* and 10*b* to better conform to the shape of the hip and therefore provide a more comfortable fit.

It will be readily apparent to persons skilled in the relevant arts that various modifications and improvements may be made to the foregoing embodiments, in addition to those already described, without departing from the basic inventive concepts of the present invention.

The following are claimed:

1. A garment clip comprising:

a body having an opening on a first side thereof, the body comprising first and second parallel side walls joined along a second side thereof by an interconnecting portion;

a clamp member formed from first and second side walls joined along a second side thereof by an interconnecting portion, the clamp member having teeth thereon adjacent a first side thereof and being receivable in the opening and slidable relative to the body from a first position in which a second side of the clamp member is contained within the body and the first side thereof extends from the opening to a second position in which the clamp member is contained within the body; and a connecting member comprising a hook having a first elongate portion located between the first and second side walls of the clamp member adjacent the interconnecting portion, an arcuate portion extending around a first end of the clamp member and a second elongate portion extending parallel to the first elongate portion on an opposite side of the interconnecting portion;

wherein a portion of material received between the teeth of the clamp member when the clamp member is in the first position is engaged by the teeth when the clamp member slides to the second position and the second elongate portion of the connecting member is received between the side walls of the clamping member of a further garment clip to engage with the further garment clip.

2. The garment clip in accordance with claim 1, wherein connecting member of the garment clip engages with the further garment clip such that the connected garment clips are pivotally connected.

3. The garment clip in accordance with claim 1, wherein when the connecting member is engaged with the further garment clip, said engagement prevents the clamp member of the further garment clip from moving from the second position to the first position thereof.

4. The garment clip in accordance with claim 3, wherein when the clamp member is received within the body such that the first side wall of the clamp member is adjacent the first side wall of the body and the second side wall of the clamp member is adjacent the second side wall of the body.

5. The garment clip in accordance with claim 4, wherein in the second position the interconnecting portion of the clamp member is located adjacent the interconnecting portion of the body.

6. The garment clip in accordance with claim 4, wherein the first and second side walls of the clamp member are angled such that first sides thereof are further apart than the second sides adjacent the interconnecting portion so that when the clamp member moves to the second position thereof, the first sides of the first and second side walls move closer together.

7. The garment clip in accordance with any one of claim 4, wherein the teeth are provided on inner surfaces of each of the side walls of the clamp member adjacent the first sides thereof.

8. The garment clip in accordance with claim 7, wherein the teeth on the first side wall are offset from the teeth on the second side wall such that in the second position the teeth on the first side wall intermesh with the teeth on the second side wall.

9. The garment clip in accordance with claim 1, wherein the second elongate portion of the hook is provided with a recess on a side adjacent the clamp member and the interconnecting portion of the body is provided with a protrusion on an inner surface adjacent a second end thereof such that the protrusion of each garment clip is received within the recess of the further garment clip.

10. The garment clip in accordance with claim 9, wherein the interconnecting portion of the body is provided with a cut away section adjacent the first end thereof such that the second elongate portion of the hook passes through the cut away portion when the clamp member and the hook slide from the first position to the second position.

11. The garment clip in accordance with claim 10, wherein a first tab extends from the first side wall of the clamp member creating an opening between the first tab and the interconnecting portion for receiving the first elongate portion of the hook.

12. The garment clip in accordance with claim 11, wherein a second flexible tab is provided adjacent the first tab extending inwardly from the interconnecting portion to engage with a corresponding notch in the first elongate portion of the hook to retain the hook.

13. The garment clip in accordance with any one of claim 9, wherein the second elongate portion of the hook is circular in transverse cross section.

14. The garment clip in accordance with claim 13, wherein the second elongate portions of a pair of connected garment clips are coaxial when the first and second garment clips are connected such that the connected garment clips can pivot relative to each other about the common longitudinal axis of the second elongate portions of the hooks.

15. The garment clip in accordance with claim 1, wherein the first and second side walls of the clamp member are provided with slots extending parallel to the direction of movement between the first and second positions thereof and the side walls of the body are provided with lugs extending from inner surfaces thereof such that the lugs are received in the slots to guide movement of the clamp member between the first and second positions thereof.

16. The garment clip in accordance with claim 15, wherein the lugs engage with inner ends of the slots to prevent the clamp member completely detaching from the body.

17. The garment clip in accordance with claim 1, wherein a padding member is provided to be secured adjacent the first side walls of the connected garment clips such that the padding member rests between the garment clips and the skin.

18. The garment clip in accordance with claim 17, wherein the padding member comprises a padded portion of material and a strip of material extending from a side thereof such that the strip of material is engaged with by the clamp and then folded to a position in which the padded portion of material is adjacent the first side walls of the connected garment clips located between the garment clips and the skin of the wearer.

* * * * *